US006425537B1

(12) United States Patent
Nielsen

(10) Patent No.: US 6,425,537 B1
(45) Date of Patent: Jul. 30, 2002

(54) FIRE EXTINGUISHING DEVICE

(75) Inventor: Per Finn Nielsen, Fredensborg (DK)

(73) Assignee: Firexpress APS, Frederikssund (DK)

( * ) Notice: Subject to any disclaimer, the term of this patent is extended or adjusted under 35 U.S.C. 154(b) by 0 days.

(21) Appl. No.: 09/595,497

(22) Filed: Jun. 16, 2000

Related U.S. Application Data

(63) Continuation of application No. PCT/DK98/00568, filed on Dec. 18, 1998.

(51) Int. Cl.[7] ..... A62C 31/00; A62C 3/07; A62C 39/00; B05B 1/34

(52) U.S. Cl. ..... 239/443; 239/463; 239/483; 169/90; 169/62

(58) Field of Search ..... 239/443, 463, 239/472, 483, 487, 490, 494, 497, 447, 419.5, 343, 424, 427, 449; 169/90, 62, 20

(56) References Cited

U.S. PATENT DOCUMENTS

| | | | | |
|---|---|---|---|---|
| 2,567,176 A | * | 9/1951 | Ballard | 239/449 |
| 2,832,424 A | | 4/1958 | Hurst | |
| 4,277,030 A | * | 7/1981 | Hechler, IV | 239/443 |
| 4,420,047 A | | 12/1983 | Bruensicke | 169/53 |
| 4,664,313 A | | 5/1987 | Yoneda | 239/456 |
| 5,031,834 A | * | 7/1991 | Simpson | 239/172 |
| 5,085,371 A | * | 2/1992 | Paige | 239/343 |
| 5,433,383 A | | 7/1995 | Sundholm | 239/383 |
| 5,639,029 A | | 6/1997 | Sundholm | 239/488 |
| 5,655,608 A | | 8/1997 | Sundholm | 169/90 |
| 5,678,637 A | | 10/1997 | O'Connell | 169/46 |
| 5,678,766 A | * | 10/1997 | Peck et al. | 239/424 |

FOREIGN PATENT DOCUMENTS

| | | |
|---|---|---|
| DE | 40 07 137 A 1 | 9/1991 |
| DE | 298 00 929 U 1 | 1/1998 |
| SE | C2 505812 | 10/1997 |
| WO | WO 92/20454 | 11/1992 |
| WO | WO 94/06517 | 3/1994 |
| WO | WO 94/26355 | 11/1994 |
| WO | WO 99/32194 | 7/1999 |

OTHER PUBLICATIONS

English Abstract of SE 505812.
English Abstract of DE 4007137.
English Abstract of DE 29800929.

* cited by examiner

*Primary Examiner*—Henry C. Yuan
*Assistant Examiner*—David Hwu
(74) *Attorney, Agent, or Firm*—Pennie & Edmonds LLP

(57) ABSTRACT

The invention relates to a fire extinguishing device that includes at least one liquid conduit connected at one end to a source with a fire extinguishing liquid under pressure, and at the other end having channels in a nozzle head with a plurality of nozzles. The channels of the nozzle head include a first channel connected to at least one atomizing nozzle for discharging liquid in atomized form, and a second channel which has an air intake. A foam nozzle is connected to the second channel downstream of the air intake for discharging a liquid in foamed form. The device can be utilized for effectively extinguishing class A, B, C, and E fires and can with one single handle be converted to fighting fires with either foam or water. The water can be atomized to a very high fineness by means of a relatively slight pressure of about 10 to 25 bar over a range of more than 10 meters. Far less water is used for extinguishing a fire than when using conventional fire extinguishing equipment.

19 Claims, 5 Drawing Sheets

FIRE EXTINGUISHING DEVICE

CROSS-REFERENCE TO RELATED APPLICATIONS

This application is a continuation of the U.S. national stage designation of PCT/DK98/00568 filed Dec. 18, 1998.

TECHNICAL FIELD

The invention relates to a fire extinguishing device of the kind which comprises at least one liquid conduit, and which at one end is connected to a source with a fire extinguishing liquid under pressure, and at the other end with channels in a nozzle head with a number of nozzles.

BACKGROUND ART

It is a well-known fact that water in its plain state is not a very effective means for extinguishing a fire as up to 98% of the water will not take part mi the extinguishing but in stead slide off the burning objects without ever reaching the primary combustion. If fire has broken out in particularly flammable liquids, such as gasoline, spraying with plain water can on the contrary result in a spreading of the fire.

The water is better utilized when it is carried in the form of small drops. An optimum utilisation is only obtained with finely atomized water which has a very large total surface and evaporates immediately when it is sprayed into areas where a combustion is taking place at a high temperature. The last-mentioned effect is extremely desirable as the smoke gases from the fire are cooled momentarily just as the violent vapour formation also displaces the combustible gases and reduces the oxygen content of the air.

During a fire, air will flow to the primary combustion zone where the oxygen content of the air will feed the combustion. As fine water drops are so small and have a mass so small that they will tend to drift in the air, they can be taken into the combustion zone where the combustion thereby is impeded or stopped altogether. Finely atomized water will also be able to penetrate fibrous material and thereby advantageously be able to reduce its combustibility while small drops merely will remain on the surface of the material.

In a cloud of finely atomized water, the drops will furthermore be so small and have a mutual distance so large that the electric conductivity of the cloud will be very small.

Finely atomized water can therefore be utilized with minimal risk for the operator even if there are live wires at the scene of the fire.

Conventionally, pressures as high as between 150 and 250 bar have been utilized in order to atomize water finely enough for the fighting of a fire. These high pressures require heavy equipment which normally only can be established in stationary and/or large units. Such heavy equipment cannot or only with difficulty be utilized for offensive fire fighting, and the resultant finely atomized water that is formed has furthermore turned out to have a range too short to be able to adequately prevent the fire fighters being injured by the heat sent out by the fire.

For quick and effective extinguishing of fluid fires (e.g., a class B fire) and securing against reignition, it can be necessary to utilize foam which forms a stable carpet of small bubbles for effectively cooling and smothering fires that are difficult to control in any other way.

At fire turn-outs, it will not always immediately be clear if the fire in question is a class A, B, C, or E fire. This means that it, at the time of the turn-out, can be uncertain whether it is one type of fire extinguishing equipment or the other that would be most effective in the given situation, and that therefore should be brought along. It is therefore an advantage if both finely atomized water and foam can be discharged from the same fire extinguishing device so that the choice between foam or finely atomized water as fire extinguishing means only need being made when the fire brigade has arrived at the scene of the fire.

It is furthermore an advantage if the quantity of fire extinguishing means necessary for extinguishing a fire is as small as possible so that the fire extinguishing device is not restricted to stationary use but can also be utilized offensively.

A combined fire extinguishing device is among others disclosed in U.S. Pat. No. 2,832,242. This device can, with a valve, be converted to discharge either atomized water or foam but from the same nozzle type. A nozzle for foam can however not be utilized for finely atomizing of water. The drops in the atomized water, which the conventional fire extinguishing device is able to discharge, will therefore be too coarse to optimally be able to fight a fire.

U.S. Pat. No. 4,420,047 discloses a similar fire extinguishing device for fitting in aircraft. The device can selectively discharge either foam or atomized water but also in this case, from the same nozzle type. This device also does not provide finely atomized water.

Thus, there remains a need for improved fire fighting devices that can provide finely atomized water as well as the versatility to be used for fighting a variety of fires.

SUMMARY OF THE INVENTION

The present invention provides a fire extinguishing device of the kind mentioned in the opening paragraph wherewith class A, B, C, and E fires can optimally be fought, that with one single handle can be converted to fighting fires either with foam or water, and that is able to finely atomize water by means of a relatively slight pressure of about 10 to 25 bar. The device can also discharge the finely atomized water with an increased horizontal range of over 10 meters.

According to the invention, this is achieved by the fact that the channels of the nozzle head comprise a first channel connected to an atomizing nozzle for discharging liquid in atomized form, and a second channel which has an air intake and downstream of which is connected to a foam nozzle for discharging liquid in foamed form.

In a preferred embodiment of the invention, the liquid conduit of the fire extinguishing device can have a first branch connected to the first channel of the nozzle head, and a second branch connected to the second channel of the nozzle head. This construction is especially simple to manufacture.

At the branch point, there can furthermore be placed a reversing valve for selectively closing the first or the second channel completely or partly so that there, with a single handle, easily and quickly can be changed between discharging of foam and discharging of finely atomized water.

Operation of the fire extinguishing device is facilitated when a flow gun is inserted into the liquid conduit wherein the flow gun has a gun valve for turning the liquid on and off respectively.

In each of the atomizing nozzles of the fire extinguishing device, there can, at a distance from the nozzle opening, advantageously be placed a partition wall extending transversely to the inner side of the nozzle and together with this defining a nozzle chamber. In the partition wall, a central opening and at least one side opening can furthermore be made. When the fire extinguishing device is utilized for fire fighting with atomized water, a finely atomized water cone is then discharged via the nozzle opening, which water cone is filled in with larger water drops for carrying the finely atomized water with it and thereby increase the range of this considerably.

A number of atomizing nozzles can advantageously be placed at a mutual distance along a circle in the end cover of the nozzle head whereby the device is enabled to discharge a relatively large quantity of atomized water in a joint bundle.

When the central openings of the atomizing nozzles furthermore are arranged with different sizes, a bundle of atomized water with degrees of atomization that advantageously cover a broad spectrum is obtained.

By placing the foam nozzle at or near the centre of the circle along which the atomizing nozzles are placed, it is obtained that foam and atomized water are discharged along the same axis so that the operator easily can change between the two extinguishing means without directly having to alter the axial orientation of the nozzle head.

BRIEF DESCRIPTION OF THE DRAWINGS

The invention will be explained in greater detail below, describing an embodiment by way of example only with reference to the drawings, in which.

DETAILED DESCRIPTION OF THE INVENTION

Water means in the following description water that has been added a foaming agent. Foam means in the following description a foam that is made of water which has been added a foaming agent and is foamed with air.

Figure 1:
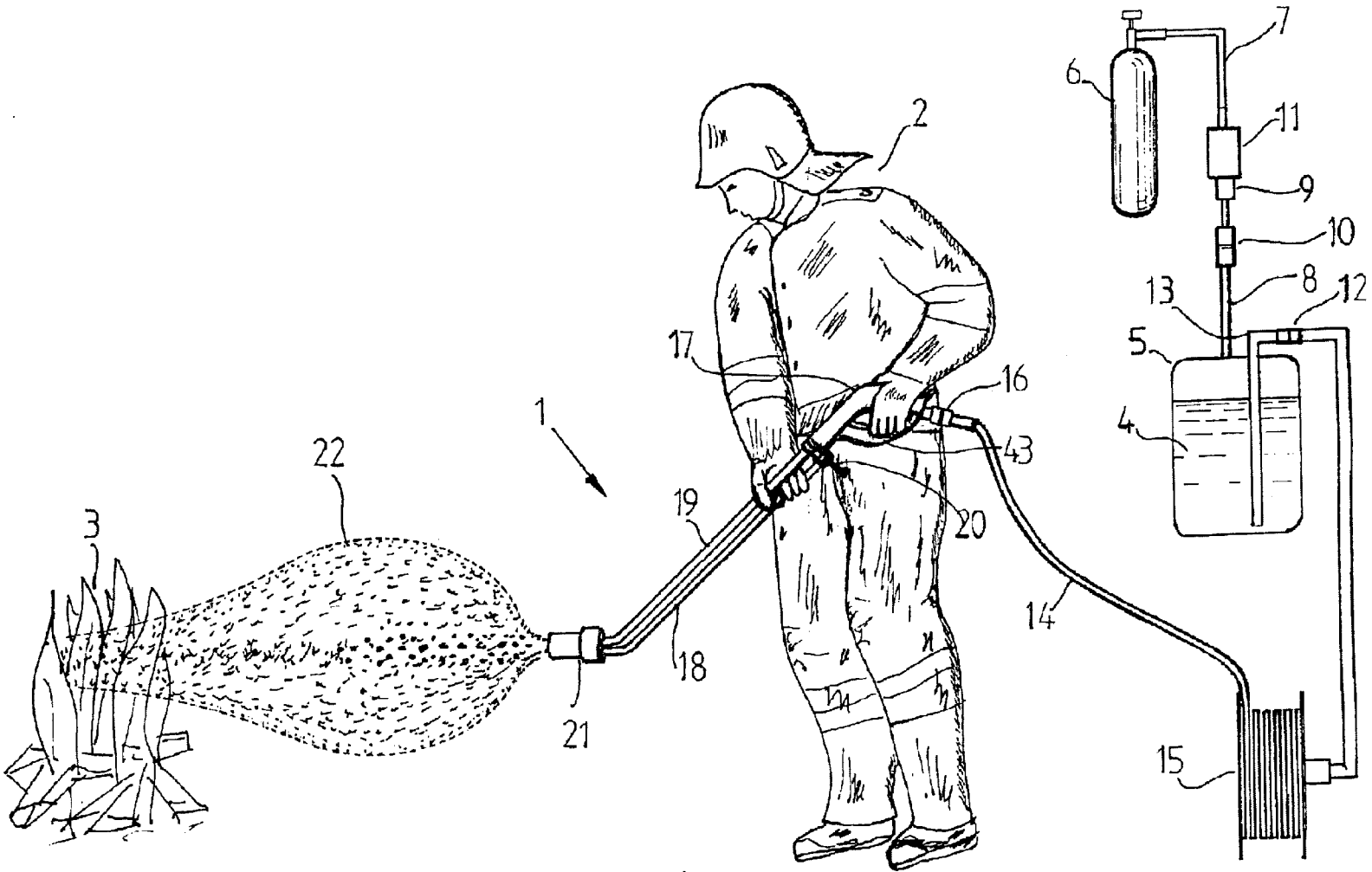
FIG. 1 shows an operator extinguishing a fire by means of a fire extinguishing device according to the invention.

FIG. 1 shows schematically an operator 2 who is extinguishing a fire 3 by means of a fire extinguishing device designated generally by the reference numeral 1.

The fire extinguishing liquid 4 is kept in a tank 5 which via gas conduits 7 and 8 is connected to a pressure bottle 6 containing a pressure gas for keeping the fire extinguishing liquid under a pressure of e.g. 10 to 20 bar. In the gas conduit 7 is inserted a pressure regulating valve 11 for regulating the pressure in the tank 5 and a non-return valve 9 for preventing back flow in the gas conduits.

In the gas conduit 8 is furthermore inserted a quick-release coupling 10 for quickly and easily assembling and disassembling the tank 5 and the pressure bottle 6. A similar quick-release coupling 12 is inserted between a liquid conduit 13 extending down into the fire extinguishing liquid 4 in the tank 5 and a liquid conduit 14 for carrying the fire extinguishing liquid 4 to the rest of the fire extinguishing device.

The length of the liquid conduit 14 is such that it ensures the operator a sufficiently large range during the fire fighting. In order to avoid that the liquid conduit 14 during this gets in the operator's way, it is wound up on a coil 15. The liquid conduit 14 is via a quick-release coupling 16 connected to the inlet end of a flow gun 17 which with a gun valve can turn intake of fire extinguishing liquid 4 on and off.

Downstream of the flow gun 17 is a branch point from where a first branch 18 and a second branch 19 as located. At the branch point is placed a reversing valve 20 for alternately turning off the first or the second of the two branches 18, 19.

Both branches 18, 19 are furthermore connected to a nozzle head 21 arranged to discharge either finely atomized water or foam. The water for the finely atomized water is supplied via the first branch 18 and the foam via the second branch 19. Near the nozzle head 21, the branches are bent an angle q whereby the operator is conveniently enabled to direct the nozzle head on the fire and reach not very accessible areas.

In FIG. 1, the first branch 18 is shown open, and as it can be seen, the fire extinguishing device 1 is then discharging finely atomized water 22.

Figure 2:
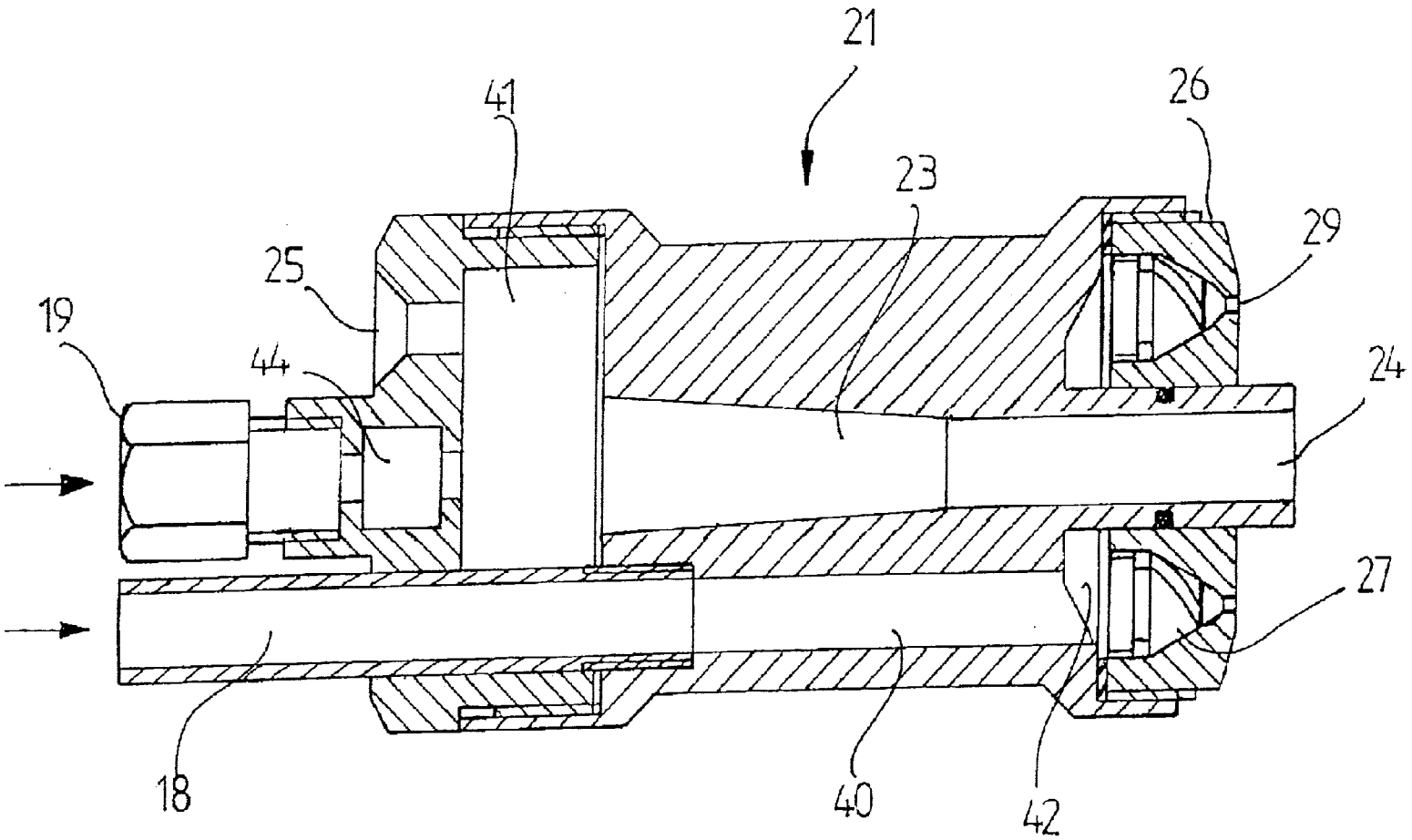
FIG. 2 is an axial sectional view of a nozzle head for the fire extinguishing device in FIG. 1.

FIG. 2 is an axial sectional view of the nozzle head 21 on a larger scale. The nozzle head has a first channel 40 connected to the first branch 18 and serving for conducting water to a number of atomizing nozzles 27 via a distribution chamber 42.

The nozzle head 21 furthermore has a foam chamber 41 which via a turbulence chamber 44 is connected to the second branch 19 and via air-intake openings 25 that are open to the atmosphere. The foam chamber is via a second channel 23 further more connected to a foam nozzle 24. When the fire extinguishing device is operating with foam as fire extinguishing means, the water is flowing via the turbulence chamber 44 where the water is set in turbulence into the foam chamber 41 into which air is, via the air-intake openings 25, taken in that foams the turbulent water. The finished foam is carried via the second channel 23 to the foam nozzle 24 and via this out towards the fire.

The nozzle head has an end cover 26 which with a thread 2 is screwed on the end of the nozzle head. The atomizing nozzles 27 with the nozzle openings 29 are made in this cover.

Figure 4:
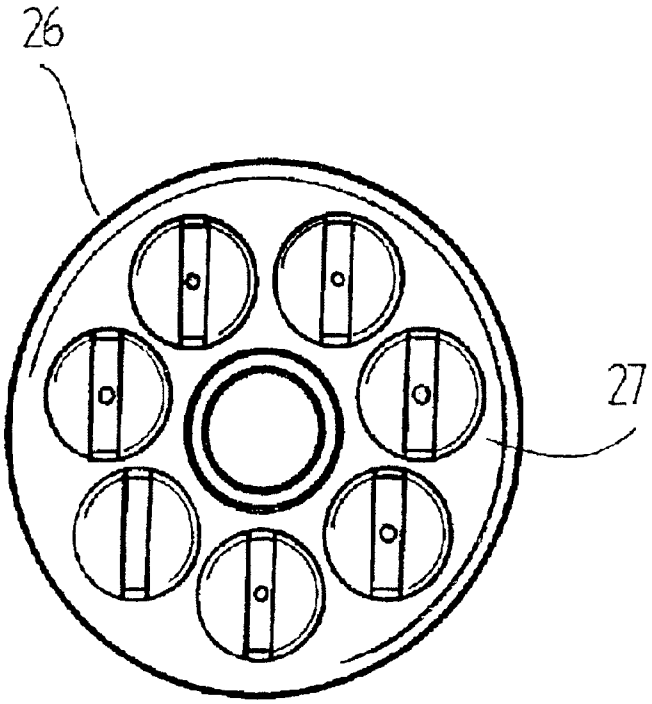
FIG. 4 is a sectional view taken along the line IV—IV of FIG. 2.
Figure 3:
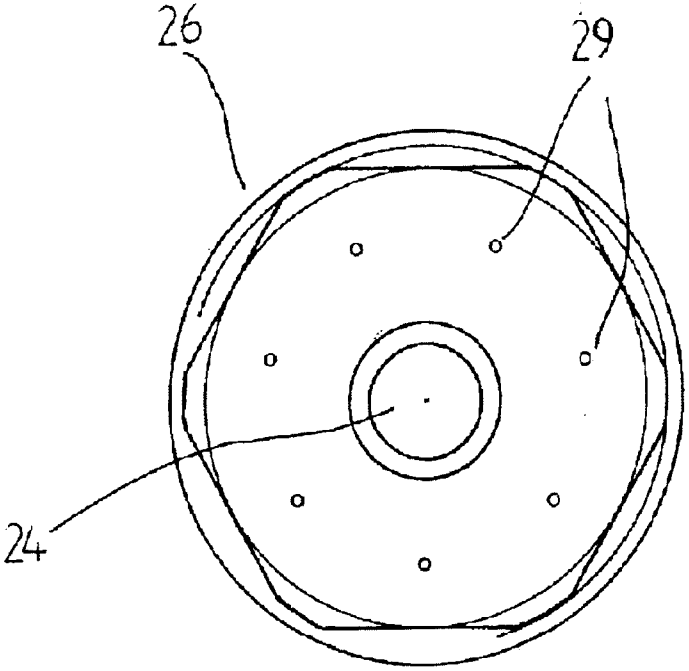
FIG. 3 is an end view of the nozzle head.

FIG. 3 shows the nozzle head 21 seen from the end with a fitted end cover 26, while FIG. 4 shows this cover seen from the back. As can be seen, seven atomizing nozzles 27 are placed along a circle. With this arrangement, it is possible to apply a quantity of water sufficiently large for fighting a fire at the same time as the very fine atomization of the water is maintained. FIG. 3 also shows that a foam nozzle 24 is placed in between the atomizing nozzles 27.

Figure 5:
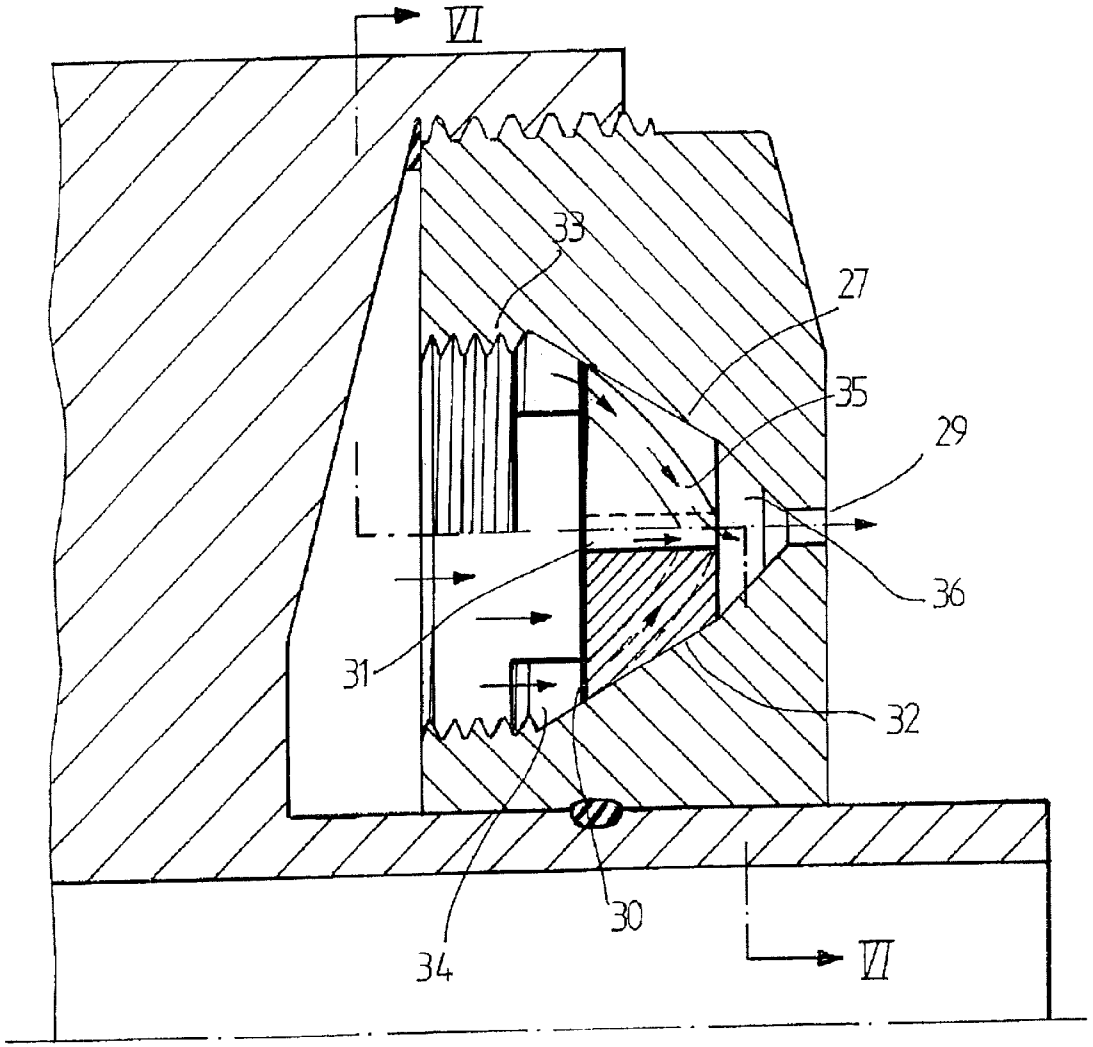
FIG. 5 is on a larger scale a fractional view of the nozzle head in FIG. 2.

FIG. 5 shows in more detail how an atomizing nozzle 27 is arranged. At a distance from the nozzle opening 29, there is by means of a thread 33 detachably placed a partition wall 32 which defines a nozzle chamber 36 in the nozzle. The thread joining makes it possible to quickly and easily remove the partition wall when the respective nozzle is to be inspected or cleaned.

In the side of the partition wall opposite from the nozzle opening is made a relatively deep, transverse groove 30, as shown in FIG. 5. Originating from the bottom of this groove, there is in the partition wall 32 made a central opening 31 which flushes with the nozzle opening 29. In the partition wall, there is furthermore made two side openings 34 which originate from each their side of the bottom of the groove 30. Each side opening is communicating with the nozzle chamber 36 via helical grooves 35 made in the periphery of the partition wall 32.

When the gun valve 43 is activated and the reversing valve 20 is set so that the first branch 18 is open and the second branch 19 is closed, water under pressure is flowing via the first channel 40 into the distribution chamber 42. Part of this water flows via the central opening 31 of each partition wall 32 into the nozzle chamber 36 of the respective atomizing nozzle 27 while the other part flows into the chamber via the side openings 34.

Figure 6:
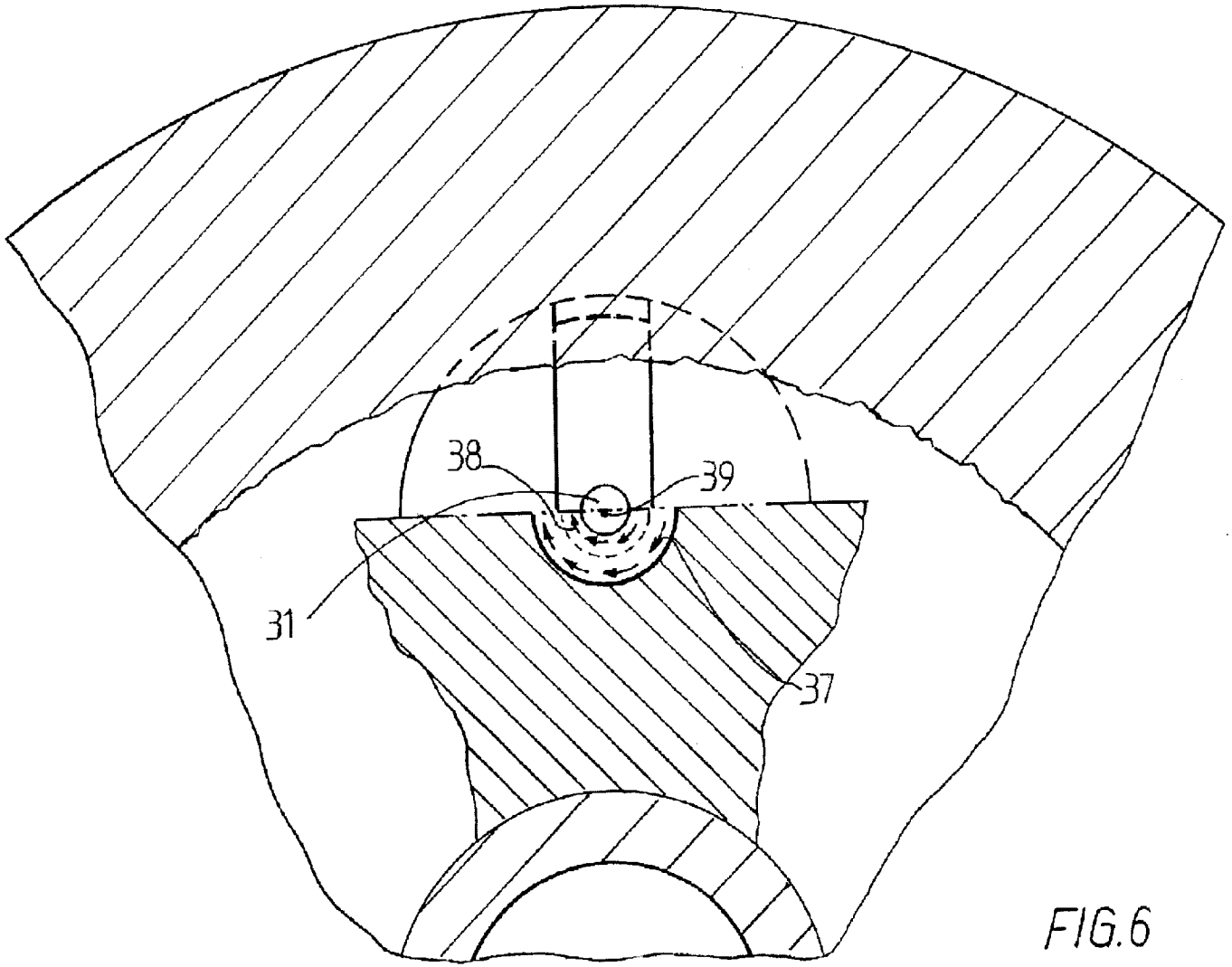
FIG. 6 is a sectional view taken along the line VI—VI of FIG. 5.

As indicated with vectors in FIG. 6, the water continues to flow from the central opening 31 mainly in a central jet 39 towards the nozzle opening 29 in the nozzle chamber 36 while the water from the side openings is set in heavy rotation in a rotating liquid layer 37 on the wall of the nozzle chamber as a result of the passage of he water through the helical grooves 35 in the periphery of the partition wall. The two very different courses of flow mean that there an intermediate layer 38 which at the transition to the rotating liquid layer 37 is rotating considerably and at the transition to the central jet 39 mainly follows its left-hand and right-hand transverse movement towards the nozzle opening 29 is made by interference in the nozzle chamber.

The substantially different flows in the nozzle chamber result in combination in discharging via the nozzle opening of a fan of finely atomised water and more coarsely atomised water which fills in the interior of the cone. The coarser water particles have a relatively great inertia and thereby a long range. During their passage through the air, the coarser water particles generate a negative pressure in the surrounding air. The negative pressure has the effect of carrying the finely atomized water along with the coarsely atomized water in the middle of the cone. By this process, the finely atomized water also obtains a long range.

When the central openings 31 of the six atomizing nozzles furthermore are arranged with different sizes, a bundle of atomized water is obtained with degrees of atomizing that advantageously cover a broad spectrum. This results in an advantageous configuration for the discharged finely atomized water as the finely atomized water first spreads in the shape of a fan outwards while it later narrows to a smaller diameter as a result of negative pressure.

Thereby, the finely atomized water at first obtains a great extent which is suitable for protecting the operator against radiant heat from the fire. The subsequent narrowing enables the operator to utilize finely atomized water for a concentrated attack on the fire.

When the gun valve 43 is activated and the reversing valve 20 is set so that the first branch 18 is closed and the second branch 19 is open, water with foaming agent is flowing via the second channel 41 into the foam chamber 41 where air is taken in via the air-intake openings 25. The air foam the water, and the finished foam is carried via the second channel 23 to the foam nozzle 24 and via this out towards the fire.

EXAMPLE

With a gas pressure of 10 to 20 bar, the same fire extinguishing device was utilized with finely atomized water to extinguish a fire in a fully furnished 19 $m^2$ room. The fire was extinguished in 15 seconds with a water consumption of about 6 litres.

The very small quantity of water that is used for extinguishing a fire by means of a fire extinguishing device according to the invention means that this with a modest quantity of water can be transported by a small vehicle such as, e.g., a motorcycle. This will reach the scene of the fire faster than a fire engine even through heavy traffic in a big city.

The fire extinguishing device can also conveniently be placed in a car, on an aircraft, or a boat, and at not very accessible ski resorts, e.g., a snow scooter can be used for transporting the fire extinguishing device to the scene of the fire.

What is claimed is:

1. A fire extinguishing device which comprises: at least one liquid conduit, one end of which is connected to a source of a fire extinguishing liquid under pressure, and an other end in fluid communication with channels in a nozzle head having a number of nozzles, wherein the channels of the nozzle head include at least one first channel connected to at least one atomizing nozzle having an inner side and an opening for discharging liquid in atomized form, and at least one second channel which has an air intake; at least one foam nozzle in fluid communication with the second channel and located downstream of the air intake for discharging liquid in foamed form; a partition wall placed at a spaced distance from the opening of the atomizing nozzle and extending transversely to the inner side of the atomizing nozzle to define a nozzle chamber, the partition wall having a central opening and at least one side opening; and means for imparting a rotary motion in the nozzle chamber to liquid flowing through the at least one side opening of the partition wall.

2. A fire extinguishing device according to claim 1, wherein the rotary motion imparting means comprise at least one groove extending along at least a part of the partition wall from the at least one side hole the periphery of the partition wall from the at least one side hole to the nozzle chamber.

3. A fire extinguishing device according to claim 1., wherein the rotary motion imparting means comprise at least one helical groove extending along at least a part of the partition wall from the at least one side hole the periphery of the partition wall from the at least one side hole to the nozzle chamber.

4. A fire extinguishing device according to claim 1, further comprising an end cover for the nozzle head and wherein a plurality of atomizing nozzles are placed at a mutual distance along the end cover of the nozzle head.

5. A fire extinguishing device according to claim 4, wherein the atomizing nozzles are arranged along a circle in the end cover.

6. A fire extinguishing device according to claim 5, wherein the foam nozzle is placed at or near the centre of the circle along which the atomizing nozzles are arranged.

7. A fire extinguishing device according to claim 1, wherein at least two partition walls of atomizing nozzles are provided and each has central openings of different size.

8. A fire extinguishing device according to claim 7, wherein at least one partition wall of an atomizing nozzle is provided without central opening.

9. A fire extinguishing device according to claim 1, wherein at least one atomizing nozzle is arranged to discharge atomized fire extinguishing liquid with a substantial content of drops of sizes smaller than 1000 micron.

10. A fire extinguishing device according to claim 1, wherein the liquid conduit has a first branch connected to the first channel of the nozzle head, and a second branch connected to the second channel of the nozzle head, and which further comprises a reversing valve for selectively closing the first or second channel at least partially, wherein the reversing valve is placed at a branch point between the first and second branches.

11. A fire extinguishing device according to claim 10, which further comprises a flow gun with a gun valve for turning the liquid on and off respectively, the flow gun inserted in the liquid conduit, with the branch point of the liquid conduit being located downstream of the gun, and wherein the first and the second branches are bent in an obtuse angle near the nozzle head.

12. The fire extinguishing device of claim 1, wherein the source of fire extinguishing liquid is under a pressure of between about 10 bar and about 20 bar.

13. A fire extinguishing device comprising:

a source of liquid under pressure;

a liquid conduit having a first end and a second end, the first end connected to the source of liquid; and a nozzle head connected to the second end of the liquid conduit; the nozzle head including:

at least one first channel connected to an atomizing nozzle configured and dimensioned to discharge the liquid in an atomized form; and at least one second channel partitioned from the first channel and connected to a foam nozzle configured and dimensioned to discharge the liquid in a foamed form; wherein the atomizing nozzle includes:

an opening for discharging the liquid; and a partition wall located at a distance from the opening and defining a nozzle chamber between the partition wall and the opening, wherein the partition wall defines a central opening into to the nozzle chamber and at least one side opening into the nozzle chamber, further wherein the side opening is configured and dimensioned to impart a rotary motion to the liquid flowing into the nozzle chamber through the side opening.

14. The fire extinguishing device of claim 13, wherein the source of liquid is under a pressure of between about 10 bar and about 20 bar.

15. The fire extinguishing device of claim 13, wherein the side opening is substantially helically shaped.

16. A nozzle head for a fire extinguishing device, comprising:

at least one first channel connected to an atomizing nozzle configured and dimensioned to discharge liquid in an atomized form, the atomizing nozzle including:

an opening for discharging the liquid; and a partition wall located at a distance from the opening and defining a nozzle chamber between the partition wall and the opening, wherein the partition wall defines a central opening into to the nozzle chamber and at least one side opening into the nozzle chamber, further wherein the side opening is configured and dimensioned to impart a rotary motion to the liquid flowing into the nozzle chamber through the side opening; and at least one second channel partitioned from the first channel and connected to a foam nozzle configured and dimensioned to discharge the liquid in a foamed form.

17. The nozzle head of claim 16, wherein the second channel includes at least one air intake located upstream of the foam nozzle.

18. The fire extinguishing device of claim 16, wherein the side opening is substantially helically shaped.

19. The fire extinguishing device of claim 1, wherein the source of fire extinguishing liquid is under a pressure of between about 10 bar and about 40 bar.

* * * * *